US012392541B2

(12) United States Patent
Solomon et al.

(10) Patent No.: US 12,392,541 B2
(45) Date of Patent: Aug. 19, 2025

(54) PORTABLE PRESERVATION REFRIGERATION SYSTEM

(71) Applicant: Desert Valley Tech Inc., Scottsdale, AZ (US)

(72) Inventors: Clint Solomon, Gilbert, AZ (US); Jeffry Skiba, Chandler, AZ (US); Burt Skiba, Mesa, AZ (US); Travis Witzke, Scottsdale, AZ (US)

( * ) Notice: Subject to any disclaimer, the term of this patent is extended or adjusted under 35 U.S.C. 154(b) by 135 days.

(21) Appl. No.: 18/101,253

(22) Filed: Jan. 25, 2023

(65) Prior Publication Data

US 2023/0235942 A1 Jul. 27, 2023

Related U.S. Application Data

(60) Provisional application No. 63/302,607, filed on Jan. 25, 2022.

(51) Int. Cl.
*F25D 19/00* (2006.01)
*B65D 81/38* (2006.01)
*F25D 17/02* (2006.01)

(52) U.S. Cl.
CPC ..... *F25D 19/006* (2013.01); *B65D 81/38* (2013.01); *F25D 17/02* (2013.01)

(58) Field of Classification Search
CPC ..... F25D 29/003; F25D 17/02; F25D 19/006; F25D 11/003; B65D 81/38; A01N 1/0263; A01N 1/02
See application file for complete search history.

(56) References Cited

U.S. PATENT DOCUMENTS 4,242,883 A * 1/1981 Toledo-Pereyra ..... A01N 1/02 435/284.1
6,046,046 A * 4/2000 Hassanein ..... A01N 1/0247 435/284.1
2004/0170950 A1* 9/2004 Prien ..... A01N 1/0247 435/284.1
2008/0145919 A1* 6/2008 Franklin ..... A01N 1/0252 435/284.1

* cited by examiner

*Primary Examiner* — Frantz F Jules
*Assistant Examiner* — Martha Tadesse
(74) *Attorney, Agent, or Firm* — Accelerate IP LLC

(57) ABSTRACT

The present application provides a unique way for storing biologics, perishables, food, drinks in a preservation and transportation system. The portable preservation system comprising a main body comprising an outer shell having at least one docking compartment and a main compartment. A cooling unit placed in the main compartment having a supply line and a return line wherein the supply line is connected to a supply manifold. At least one valve wherein the valve is connected to the supply manifold. At least one supply connection port wherein the supply connection port is coupled to at least one opposing port which supplies coolant to an external system having an inlet and outlet wherein the outlet is connected to at least one return connection port.

11 Claims, 4 Drawing Sheets

PORTABLE PRESERVATION REFRIGERATION SYSTEM

CROSS-REFERENCE TO RELATED APPLICATIONS

This application claims benefit from currently U.S. Provisional Application No. 63/302,607 titled "Portable Preservation Refrigeration System" and having a filing date of Jan. 25, 2022, all of which is incorporated by reference herein.

BACKGROUND

The present invention relates to a portable environmental storage, preservation, and a transportation docking system more particularly, a portable, actively cooled, or heated storage system.

TECHNICAL FIELD

Various types of devices are used for safely storing and carrying vaccines, blood, plasma, biofilms, and organs collectively referred to as biomaterials or biologics. For example, military field medics carry medical equipment that can weigh from 50 lbs. to 80 lbs. including bandages, saline, tourniquets, tubing, gauze, and other lifesaving materials. However, current devices require the field medic to carry an insulated container that is passively cooled with ice, requiring a bulky freezer or refrigerator to keep lifesaving biomaterials at the recommended storage conditions. Because each of these biomaterials have a recommended storage condition to be viable, multiple devices are needed to accommodate each storage condition. For example, human organs and vaccines must be transported at different conditions to keep the vaccines potent, and human organs from dying than blood products, and pharmaceuticals.

Current mobile storage devices for lifesaving biomaterials are passively cooled meaning the device uses ice, or ice products such as ice packs with thick Styrofoam or polystyrene lined shells. The passive storage of biomaterials has a number of disadvantages including, ice melting causing condensation on the organ or blood spoiling the product. Ice will additionally create inconsistent temperature variation within the container causing an uncertainty of whether the biomaterials are viable or as potent. This device will expand the capability of shipping containers by enabling tracking of the contents, real time delivery of informatics on the contents condition and actual location to anticipate delivery time of arrival, because the transport of perishables such as blood has an expiration due to storage conditions, time and temperature, improvements in the design of the transport device and Realtime monitoring of the storage conditions combine to create a much more robust system. In addition, perishable products inventory can be created through the tracking program creating yet another value added to this proposed device.

Blood products such as plasma, platelets, red blood cells, or whole blood usually come in blood bags and must be stored at specific temperatures to maintain freshness and usability. Using ice, or ice-like packs can cause inconsistencies within the temperature range of the blood inside the bag creating uncertainties regarding whether the blood is safe for transfusion. The blood product, usually delivered in a blood bag, must be in contact with heavy ice or ice packs to stay within a certain temperature range. The areas of ice not in contact with the blood bag results in higher temperatures which may exceed acceptable storage temperatures where the blood or plasma product could spoil. In addition, the storage environment of different types of blood products varies in temperature, for example, whole blood must be stored between 1 to 6 degrees Celsius and cannot freeze, plasma must be stored at −18 degrees Celsius or colder, and platelets must be stored between 20 to 24 degrees Celsius. Using ice or ice packets can only give off a baseline temperature of around 0 degrees Celsius. There is not currently a portable product on the market today that can adjust to a set temperature and to different required environmental conditions to fit the different types of blood products, organs, and vaccines in remote locations.

A further disadvantage of the use of ice or ice packets for storing biomaterials is that ice is heavy, turns from solid to liquid as it melts and requires a freezer to refreeze it. In a disaster area or where military casualties require blood, the blood is usually taken from the donor from a hospital or from the military base. Once the blood is taken it is placed into a blood storage refrigerator until it is shipped. At that time, it is transferred into a shipping container along with ice and the countdown starts for when that blood will eventually be unusable. Once the blood temperature rises above 10 degrees C., it must be used within 24 hours or discarded. If the blood product is not transfused into an injured person, the precious blood will be thrown out if not used. Therefore, there must be an ample supply of ice as the blood products, organs, and vaccines are transported from location to location, which just is not available at the front line of a military conflict.

Therefore, it would be advantageous to provide a storage and preservation docking system that can actively cool multiple canisters without freezing the contents and keep the viability of the contents at the front lines or in an emergency scenarios.

SUMMARY

Aspects disclosed herein relates to a portable biologic preservation system comprising a main body comprising an outer shell having at least one docking compartment and a main compartment. A cooling unit placed in the main compartment having a supply line and a return line wherein the supply line is connected to a supply manifold. At least one valve wherein the valve is connected to the supply manifold. At least one supply connection port wherein the supply connection port is coupled to at least one opposing port which supplies coolant to an external system having an inlet and outlet wherein the outlet is connected to at least one return connection port. The main compartment can further comprise at least one one-way valve coupled to the supply connection port and the return connection port wherein the return connection port is coupled to at least one return manifold that is coupled to a reservoir wherein the reservoir is coupled to the return line of the cooling unit. The valve is a solenoid valve. The supply manifold has at least one inlet and at least one outlet which is connected to the corresponding valve that supplies each external system. The docking compartment is sized to accommodate varying sizes of external systems.

The main compartment can further comprise a purge air system that is connected between the supply line and the supply manifold. The solenoid valve is activated to open the flow to allow coolant through to each external system. The coolant is water, liquid refrigerant, or any mixture thereof.

The cooling unit supplies coolant to the external system. The outer shell is thermally insulated. The docking compartment is at least one compartment.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

DETAILED DESCRIPTION

Figure 1:
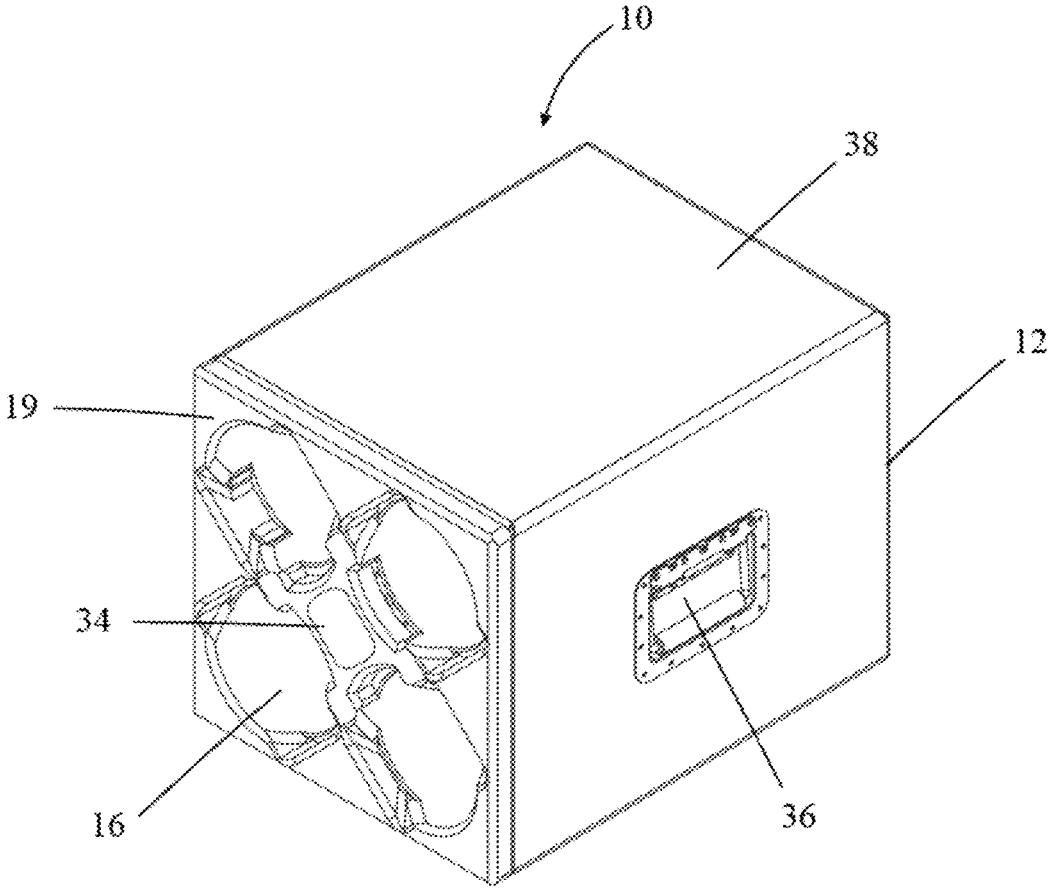
FIG. 1 shows an isometric view of a portable preservation system in accordance to one or more embodiments.
Figure 2:
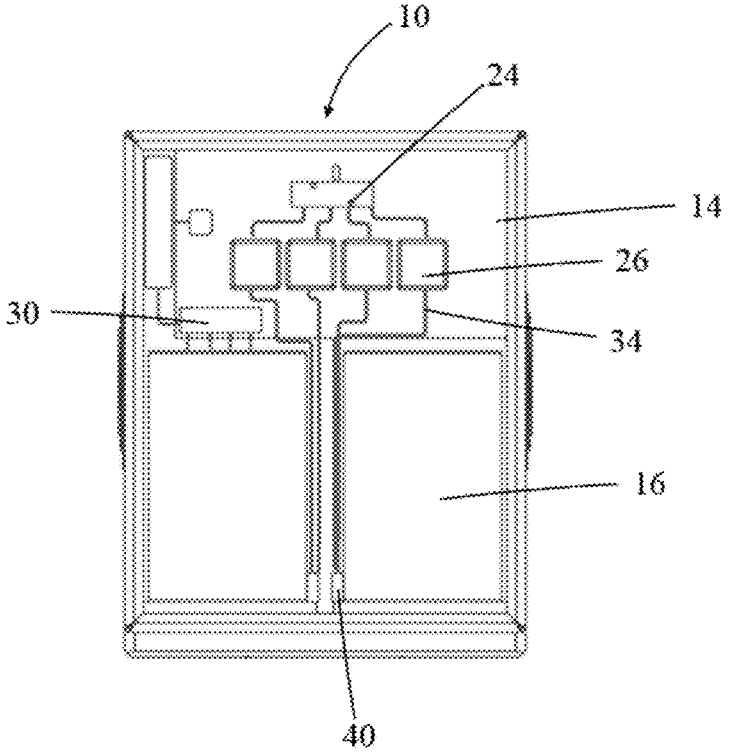
FIG. 2 shows a top view with the cover omitted of a portable preservation system in accordance to one or more embodiments.
Figure 3:
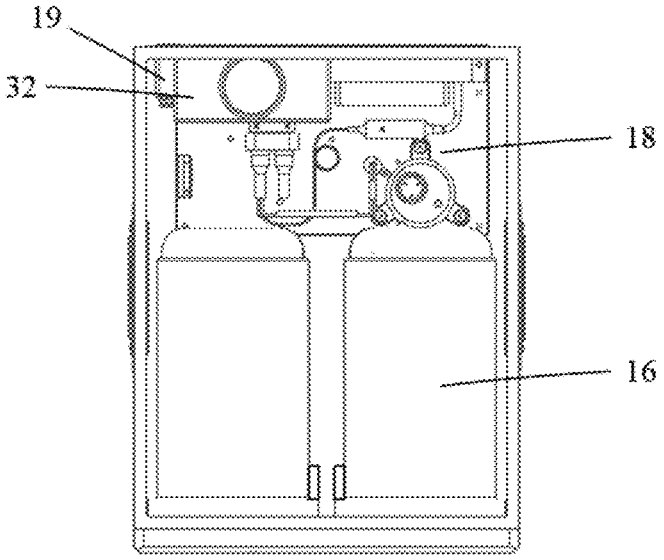
FIG. 3 shows a front view of a portable preservation system in accordance to one or more embodiments.

The embodiments of the invention described herein are not intended to be exhaustive or to limit the invention to precise forms disclosed. Rather, the embodiments selected for description have been chosen to enable one skilled in the art to practice the invention.

Referring initially to FIG. 1-5, a portable preservation system is shown Accelerate IP LLC generally at 10. The portable preservation system 10 comprises a main body 12 forming an enclosure having at least one docking compartment 16 and a main compartment 14. A cooling unit 18 can be removably or permanently placed in the main compartment 14 wherein the cooling unit can have a supply line 20 and a return line 22. The supply line 20 can be connected to a supply manifold 24 by a tube 25 wherein the tube can be such as, for example, stainless steel, copper, aluminum, plastic tubing, piping or the like. In certain embodiments, the cooling unit 18 can be placed in and attached to a protective case (not shown) wherein the protective case can be attached to the outer shell 13 with at least one fastener wherein the fastener can be such as, for example, a bolt, screw, rivet, or the like.

Figure 6:
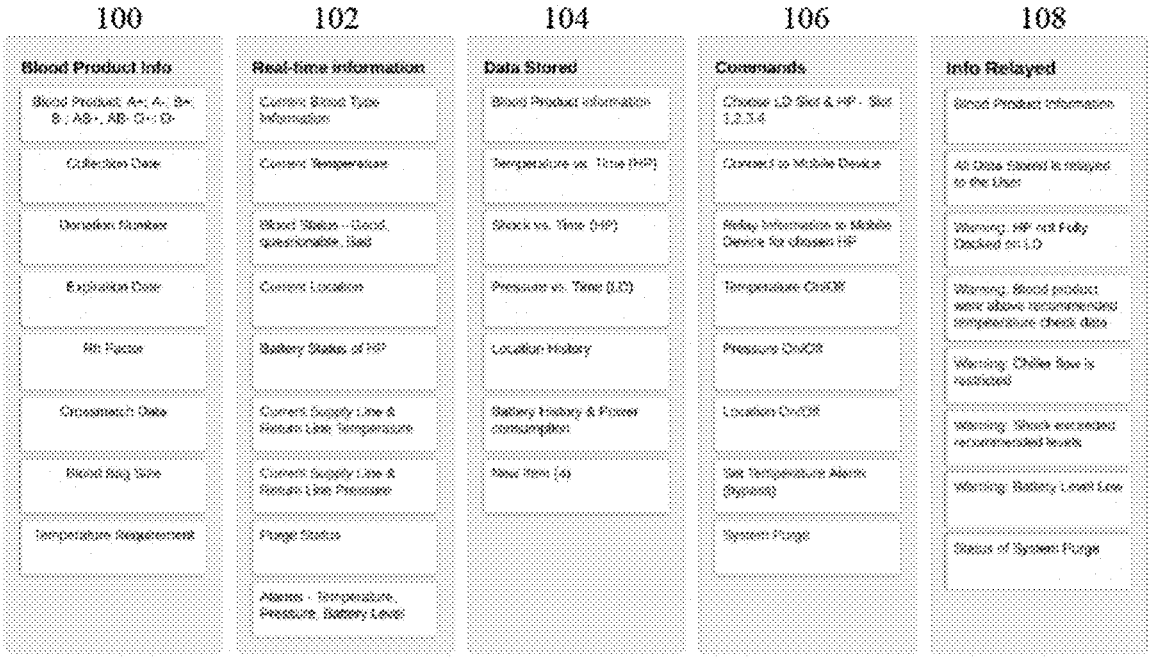
FIG. 6 shows a flow diagram of a portable preservation system in accordance to one or more embodiments.

In embodiments, the main body 12 can be made from such as, for example, sheet metal, stainless steel, plastic, aluminum, or the like and in certain embodiments the main body can have an outer case, covering, or wrap that protects the main body. The main body 12 can manufactured by at least one of such as, for example, forming, stamping, molding, casting or the like. The main body can be any suitable shape or size to house at least one external system 60 as shown in FIG. 6 and any additional components as listed below, as necessary.

The cooling unit 18 can be placed in the main compartment 14 either vertically or horizontally wherein the cooling unit can have a maximum tilt angle of operation or in other embodiments there is no maximum tilt angle. The cooling unit 18 can be such as, for example, a chiller, thermal electric cooler, liquid cooled chiller, air cooled chiller, compact chiller, or the like. The cooling unit 18 can use refrigerant or any other cooling liquid as necessary, and in other embodiments the cooling unit does not need cooling liquid. In certain embodiments the cooling unit 18 can be attached directly to the main compartment 14 by such as, for example, stand offs, tabs, rails, or the like or it can be surrounded by a protective shell that goes around the cooling unit to keep the unit separate from the other components within the main compartment 14.

In certain embodiments, the cooling unit 18 can have a heater added inline or on the inside or outside docking compartment 16 to provide heat to the system, or a separate heater can be placed in line with the tubing 25. The heating unit (not shown) can be such as, for example a Peltier device, heating coils, heating blankets or the like. In embodiments, the main body 12 can be insulated wherein the inner walls can have a layer of insulation coupled to it and the docking compartment 16 can have insulation wrapped around each docking compartment 16 wherein the insulation can be such as, for example, cotton, cellulose insulation material, foam board, radiant barrier, spray foam, insulated panels, aerogels, or the like.

In embodiments, the cooling unit 18 coolant feed can be coupled to purge air 28 which can be coupled to at least one supply manifold 24. The supply manifold 24 can be such as, for example, a straight flow manifold, rounded manifold, dual section manifold, right angle manifold, or the like having at least one inlet and at least one outlet. The supply manifold 24 can be connected to at least one valve 26 by at least one tube 25 having the same or similar properties as the tubes as listed above, wherein the coolant from the cooling unit 18 can flow from the supply line 20 to the supply manifold 24 to the valve 26.

The valve 26 can be such as, for example, a solenoid valve, coaxial valve, two-way valve, a three-way valve, direct acting valve, pilot-operating valve, four-way valve, or the like. The valve 26 can be normally open or normally closed and in the preferred embodiment the valve can be normally closed to stop the flow of the coolant until it is needed. The user or a program on a microcontroller unit ("MCU") can selectively choose which valve 26 is opened and which valve is closed depending on which external system 60 requires cooling. The purge air 28 can be such as, for example, exhaust blower, dry air purge, air system, or the like. The purge air 28 can remove the coolant from the external system 60 or in other embodiments the purge air is omitted. Once the external system 60 is reconnected the cooling unit 18 can repressurize the system keeping pressure on the external system as coolant flows through it.

The valve 26 can be connected to at least one supply valve 28 by a tube or directly coupled to the valve wherein the supply valve can be such as, for example, a check valve, one-way valve, ball valve, relief valve, isolation valve, regulation valve, or the like. The supply valve 28 can keep the coolant from flowing back through the supply line and can keep pressure on the system in the lines when the cooling unit 18 is off. The supply valve 28 can be connected directly to or coupled to at least one tube which is coupled to at least one supply connection 40 wherein the supply connection can be such as, for example a quick disconnect, snap-type, ball latching, bayonet, threaded, non-latching, or the like which can automatically or manually shut off the flow to the external system 60 or by disconnecting the external system from the supply connection. In certain embodiments the manifold 24, the valve 26, the supply valve 28, or the supply connection 40 or any combination thereof can be omitted from the supply line or coolant feed line.

In embodiments, the return line 22 can be coupled to a reservoir 32 wherein the reservoir can be such as, for example, a recovery tank, a coolant overflow tank, an expansion tank, or the like which can be 0.125 ml to 5 liters. The reservoir 32 can be connected or coupled to at least one tube which is connected to a return manifold 30 or in other embodiments the reservoir can be connected directly to the return manifold or a coolant return 22 within the cooling system 28. The return manifold 30 can have the same properties as the supply manifold 24 wherein return manifold can be connected to or coupled directly to at least one tube and to a return valve 29.

The return valve 29 can be connected to at least one return connection 41 wherein the return connection can be such as, for example a quick disconnect, snap-type, ball latching, bayonet, threaded, non-latching, or the like which can automatically, electronically, or manually shut off the flow to the external system 60 or by disconnecting the external system from the return connection. In the preferred embodiment, the supply connection and the return connection can be one connection incorporating both the supply and return into a single connection. In certain embodiments, the return manifold 30, the return valve, the return reservoir 32 or any combination thereof can be omitted from the return. In certain embodiments there can be more than one supply line and return line per docking compartment 16.

In certain embodiments, coils (not shown) can be wrapped around the docking compartment 16 and the supply valve 28 and return valve 29 can be connected to directly to the coils which can externally heat or cool the external system 60. The external system 60 can be docked in the docking compartment 16 and be connected to the supply connection 40 and return connection wherein as coolant cycles through the external system the external system cools or can be heated.

In embodiments, the outer shell 13 can have a front panel 19 and a top 38 wherein the front panel can have at least one location for the at least one docking compartment 16. The front panel can further comprise a latching mechanism to secure the external system in the docking compartment. The external system can slide into the docking compartment wherein the when the external system is engaged or not engaged, by a switch, the switch notifies the system whether it is fully engaged, if it is not engaged then an alarm is sent to the user, if it is fully engaged then the MCU is notified a green light or something equivalent is sent to the user notifying the user that the system is ready to cool. The MCU recognizes which docking compartment the external system is in and check temperature of its cargo to determine if the cargo is at the user's specified temperature. If the temperature is not at the set temperature the MCU activates the chilling unit, opens the valve to that specified docking compartment and begins to cool or heat the external system to the user's specified set temperature. The outer shell can further comprise at least one handle wherein the handles can be on the top, side, back, front or bottom of the outer shell and can allow the user to easily carry the system.

In embodiments, the cooling unit 18 can supply coolant through the supply manifold through the valve 26, through the supply valve 28 and through the supply connection 40 to the external system 60. The coolant can run through the external system 60 and then back to the cooling unit 18 by flowing through the return connection 41, through the return valve 29, through the manifold into the reservoir and then back through the cooling unit to chill back down creating a closed loop system to cool down an external system. The cooling unit 18 can cool down an external system 60 from ambient temperature down to at least −60 degrees Celsius or heat up an external system from −60 to 250 degrees Celsius.

Figure 4:
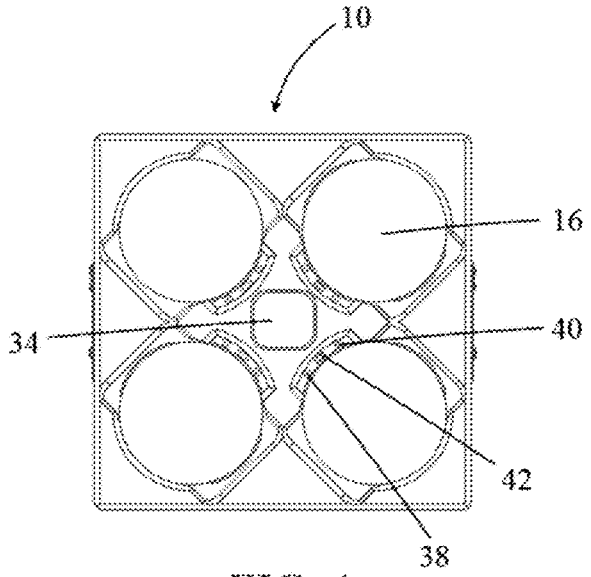
FIG. 4 shows a front view of a portable preservation system in accordance to one or more embodiments.
Figure 5:
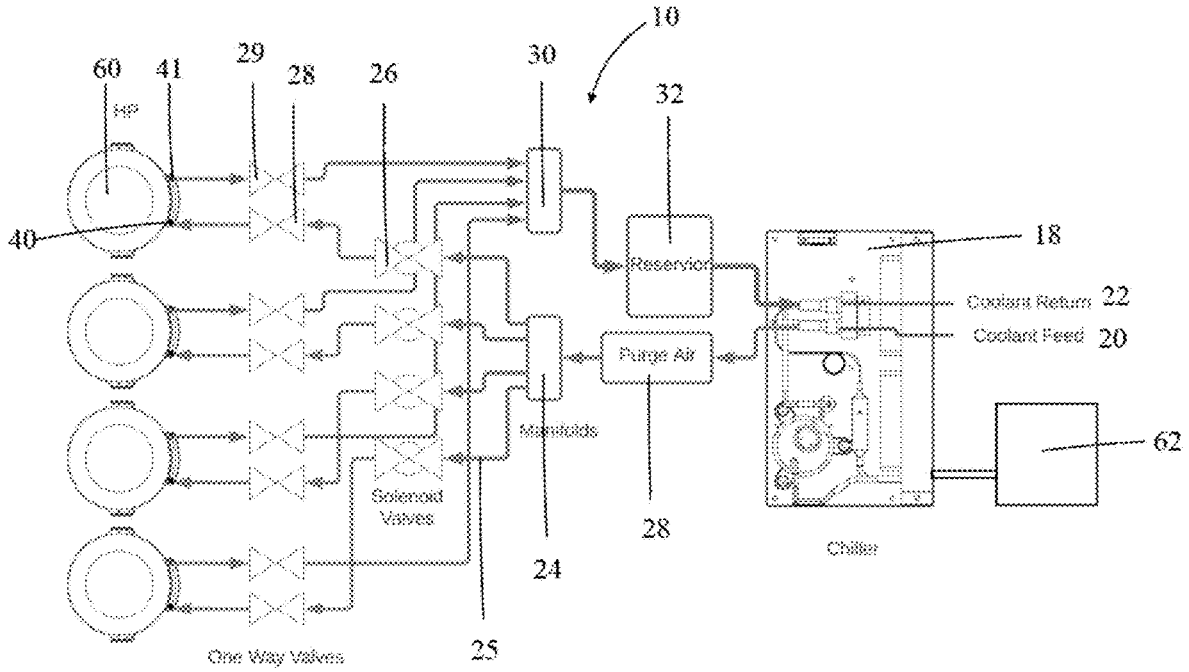
FIG. 5 shows a overall layout schematic of a portable preservation system in accordance to one or more embodiments.

The portable biologic preservation system 10 can further comprise a microcontroller unit ("MCU") (not shown) that can send information to the user via a portable computing device or the onboard screen 34 as shown in FIG. 4. The MCU can be connected to the cooling unit 18 and valves 26 wherein the user or a program can set the temperature and activate the cooling unit and can recognize which external system 60 is docked within the docking compartment 16. The program can open the valve 26 allowing coolant to flow to the external system 60 where it is docked within the docking compartment 16, cooling the external system down to the desired set temperature and only to the docking compartment that has an external system docked in it. The cooling system 18 can have a no freeze alarm which allows the MCU to monitor the contents of the external system 60 and will either shut off or warm up the contents if an alert is thrown that the contents are getting close to freezing unless the user overrides this for contents that need to be frozen, but for blood the MCU will adjust the cooling system to turn on and off when cooling is needed and not freeze the blood.

In the preferred embodiment, the MCU can monitor the external system when placed in the docking compartment 16 through an electrical connection port 42, as shown in FIG. 4, wherein the electrical connection port allows the MCU to communicate to the sensors and the external system's onboard controller. The electrical connection port 42 can be such as, for example, ribbon connection, USB, micro-USB, USB-C, D-sub connectors, or the like. The MCU can monitor each external system's sensors wherein the sensors can be such as, for example, temperature sensor, pressure sensor, GPS, humidity sensor, accelerometer, or the like while docked or in close proximity. The portable preservation system 10 can further comprise an external power source or in other embodiments an internal power source 62 which can be connected to the portable preservation system by a power adapter 19. The external power source 62 can be such as, for example, DC power source, AC power source, AC to DC or DC to AC power source, CIC PowerBox™, or the like.

In the preferred embodiment, the MCU can actively monitor the temperature sensor in the external system. The user can input the desired cargo's temperature wherein the MCU will monitor the cargo's temperature compared to the user's desired temperature or the cargo's requirement temperature having a upper limit and a lower limit, such as blood that needs to be stored between 4-10 degrees Celsius. The MCU will check the external system's temperature at such as, for example, 1-1000 Hz wherein the when the temperature starts to creep to the cargo's upper limit, the MCU triggers the cooling unit 18 to turn on and open the valve 26 to the external system 60 that needs to be cooled back down to the lower limit. Once the external system 60 is cooled back down to the lower limit then the MCU turns off the chilling unit 18 and closes the valve. In certain embodiments a purge air system can be placed between the chilling unit 18 and the supply connection 40. The purge air system 28 can expel the coolant that is in the lines and in the external system pushing it into the reservoir 32.

In certain embodiments, the portable biologic preservation system 10 can further comprise a heating unit (not shown) wherein the heating unit can heat each at least one external system to the user's desired set temperature range.

The heating unit can be such as, for example, a thermal electric cooler, heating coils, heat pump, electric heater, or the like. The heating unit can be in line with the supply line, or it can be on the docking compartment or within the external system.

A portable system 10 can comprise a method of cooling at least one external system comprising setting a maximum and minimum temperature setting for the external system's cargo, actively monitor the cargo's temperature in each external system, activating chilling unit and the valve wherein the valve is opened allowing the flow of coolant into the external system. Monitoring the external system while the cooling unit is activated wherein once the temperature is in acceptable range the cooling unit is turned off and the valve is closed. In certain embodiments the one or more valves can be open allowing the cooling unit to cool down more than one external system.

Referring to FIG. 6, the portable biologic preservation system 10 can have user interface ("UI") that is menu driven through either a portable computing device or the onboard screen 34. For example, when an external system 60 is docked into the docking compartment 16, the biologic preservation system takes control of the external system and information from external system is relayed to and from the biologic preservation system. When separated, the external system 60 goes on its own system and relays its information separate from the biologic preservation system through a portable computing system. The biologic preservation system 10 communicates with the user through both an onboard screen or through a portable computing system. The UI can be the main point of interaction and communication with the biologic preservation system 10 and external system 60. At step 100, the UI lets the user choose the biologic type, blood type, collection date, donation number, expiration date, Rh date, crossmatch data, blood bag size and temperature requirement which can be relayed to supply chain system for inventory control and monitoring.

At step 102, the UI can read the real-time information such as current blood type information within the external device 60, quantity of blood in the container, current temperature in the external device, blood status such as good, bad, and questionable, current location, battery status of external device, current supply line and return line pressure, purge status and alarms such as temperature, pressure battery level. The biologic preservation system 10 can read a barcode or RFID that was assigned to the blood products at the time it was taken from the donor, and then assigns the temperature settings (high and low). The portable computing device can scan and upload the barcode or RFID tag information and transfers that information to the biologic preservation system 10 or external system 60 wirelessly or through USB.

Depending on what the external device 60 communicates with, the commands could come from either the biologic preservation system 10, the portable computing device or the external system 60 itself. For example, if the external system 60 is docked on the biologic preservation system 10, the biologic preservation system receives the data that was logged onto the external system's storage, in addition the external system stores the cargo type, the cargo's temperature range, and cargo temperature history. The user can set the information through the portable computing device, the biologic preservation system 10 or external system 60 and each can send and receive commands to the biologic preservation system or the external system. The data is collected on the storage drive and on the microcontroller unit ("MCU") converts the data collected from the sensors.

At step 104 the data can be stored from the external system within the biologic preservation system 10 the data can be such as, for example, blood product information, temperature vs. time, shock vs. time, pressure vs. time, location history, battery history and power consumption. At step 106 the user or the biologic preservation system 10 can choose which docking compartment 16 is being used and then connect to the portable computing device, relay the information to the portable computing device, turn the cooler on or off to match the set temperature, turn the pressure on or off within the system, turn the location on/off, set a temperature alarm, and system purge. At step 108 the information that can be relayed to the user can be the blood product information, all data stored, warnings when the external system 60 is not fully docked, warning that the cargo went above the recommended temperature, warning on cooling unit flow, warning that system exceeded the shock, warning of battery level and status of system purge.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the embodiments otherwise claimed. No language in the present specification should be construed as indicating any non-claimed element essential to the practice of the disclosed embodiments.

What is claimed is:

1. A portable preservation system comprising:

a main body having an outer shell with at least one docking compartment configured to removably hold an external system and a main compartment;

a cooling unit placed in the main compartment having a supply line and a return line wherein the supply line is connected to a supply manifold;

at least one valve wherein the valve is connected to the supply manifold; and at least one supply connection port wherein the supply connection port is coupled to at least one opposing port which is configured to supply coolant to the external system having an inlet and an outlet wherein the outlet is connected to at least one return connection port.

2. The portable biologic preservation system of claim 1, wherein the main compartment can further comprise:

at least one one-way valve coupled to the supply connection port and the return connection port wherein the return connection port is coupled to at least one return manifold that is coupled to a reservoir wherein the reservoir is coupled to the return line of the cooling unit.

3. The portable biologic preservation system of claim 1, wherein the valve is a solenoid valve.

4. The portable biologic preservation system of claim 1, wherein the supply manifold has at least one inlet and at least one outlet which is connected to the valve that supplies the external system.

5. The portable biologic preservation system of claim 1, wherein the docking compartment is sized to accommodate varying sizes of external systems.

6. The portable biologic preservation system of claim 1, wherein the main compartment can further comprise a purge air system that is connected between the supply line and the supply manifold.

7. The portable biologic preservation system of claim 3, wherein the solenoid valve is activated to open the flow to allow coolant through to the external system.

8. The portable biologic preservation system of claim 1, wherein the coolant is water, liquid refrigerant, or any mixture thereof.

9. The portable biologic preservation system of claim 1, wherein the wherein the cooling unit supplies coolant to the external system.

10. The portable biologic preservation system of claim 1, wherein the outer shell is thermally insulated.

11. The portable biologic preservation system of claim 1, wherein the docking compartment is at least one compartment.

* * * * *